US005080603A

United States Patent [19]

Mouissie

[11] Patent Number: 5,080,603

[45] Date of Patent: Jan. 14, 1992

[54] MOUNTABLE CONNECTOR FOR CABLE ASSEMBLY

[75] Inventor: Bob Mouissie, Berlicum, Netherlands

[73] Assignee: E. I. Du Pont de Nemours and Company, Wilmington, Del.

[21] Appl. No.: 565,123

[22] Filed: Aug. 10, 1990

[30] Foreign Application Priority Data

Aug. 30, 1989 [NL] Netherlands ..... 8902192

[51] Int. Cl.[5] ..... H01R 13/627

[52] U.S. Cl. ..... 439/353

[58] Field of Search ..... 939/368, 369, 350–358, 939/536

[56] References Cited

U.S. PATENT DOCUMENTS

| | | | |
|---|---|---|---|
| 2,895,119 | 7/1959 | Montgomery, Jr. | 339/91 |
| 3,133,777 | 5/1964 | Anhalt | 439/358 |
| 3,544,951 | 12/1970 | Roberts | 439/358 |
| 4,089,579 | 5/1978 | Steinbach | 339/91 |
| 4,451,106 | 5/1984 | Wiseheart et al. | 439/536 |
| 4,526,431 | 7/1985 | Kasukawa | 439/353 |
| 4,838,809 | 6/1989 | Mouissie | 439/358 |

FOREIGN PATENT DOCUMENTS 2303393 10/1976 France .

*Primary Examiner*—Gary F. Paumen
*Assistant Examiner*—Kevin J. Carroll

[57] ABSTRACT

A mountable receptacle connector for mating with a cable connector which has resilient cantilevered, locking members. The mountable connector is provided with a separate locking frame fitted on the housing of the mountable connector at the mating end thereof. The locking frame is provided with receiving and locking means for the locking member.

6 Claims, 2 Drawing Sheets

MOUNTABLE CONNECTOR FOR CABLE ASSEMBLY

BACKGROUND OF THE INVENTION

This invention relates to a receptacle connector for mating with a cable connector, and, more particularly, to a receptacle connector adapted for mounting in electronic equipment and which is provided with a locking frame for mating with a cable connector.

Cable connectors must often times mate with and lock to receptacle connectors mounted or built into electronic equipment. FIG. 1 shows, for example, such a cable assembly. A cable connector 1 is provided with a housing 2 of insulating material provided with resilient cantilevered latching members 3. The receptacle connector 4 has a housing 4a of insulating material with upright free wall parts 7 and 8 which are separated by a distance away from a central part 5 provided with contact plug sockets 6. Between these upright wall parts 7 and 8 and the central part 5 is a space adapted to receive a collar 12 of the cable connector 1. Within this collar 12 are pin contacts (not shown) which will be received by the plug sockets 6. When the cable connector 1 is inserted into the receptacle connector 4, detents or bosses 9 on the end of the latching members 3 are first pressed inwards by the upright walls 7 and 8. When the cable connector is fully seated in the receptacle connector, the bosses 1 spring back into the recesses 10 and 11 to latch the connectors together.

Receptacle connectors mounted or built into electronic equipment cannot however, always be provided with the free upright peripheral wall parts 7 and 8. Such built-in receptacle connectors 4 in fact may have a surrounding collar 12 such as shown in FIG. 2 which must be fed in a close fit through an aperture in a wall of the electrical equipment and then mounted. The built-in receptacle connector 4 of FIG. 2 surrounds the pin contacts 14. Such a built-in receptacle connector can also be in the form shown in FIG. 1 with plug sockets but without the free upright wall parts 7 and 8. There are also other applications for which the wall parts 7 and 8 cannot be used.

SUMMARY OF THE INVENTION

To facilitate latching of cable connectors with such receptacle connectors mounted in electrical equipment, the invention provides a separate locking frame which fits around the above described peripheral wall of the central part 5 of FIG. 1 or the collar 12 of FIG. 2 and which can be locked thereon. The locking frame is also provided with receiving and locking means for the above described latching members of the cable connector.

After the receptacle connector is mounted in the electronic equipment, the locking frame can be pushed onto the projecting central part 5 (FIG. 1) or collar 12 (FIG. 2) and locked thereon. The receptacle connector is then provided with means for accommodating the latching members 3 and bosses 9 of the cable connector 1.

To secure the locking frame on either the peripheral wall of the central part 5 or the collar 12, the wall or collar is preferably provided with boss guide and locking means. The locking frame itself is provided with recessed bosses for mating with these means.

The boss guide means on the peripheral wall are formed by tapered, slanted faces which extend tapering outwards from a line lying within the peripheral wall at the front side of the wall in the mating direction of the cable connector into the plane of the peripheral wall, where the guide faces merge into recessed locking faces lying at right angles to the peripheral wall. The locking frame is to this end provided with recessed bosses disposed on the inside wall for mating with the boss locking faces in the peripheral wall.

The inside wall of the locking frame is provided with guide and locking faces for the bosses on the latching members The invention will now be explained in greater detail with reference to the drawings.

DETAILED DESCRIPTION OF THE EMBODIMENT

Figure 2:
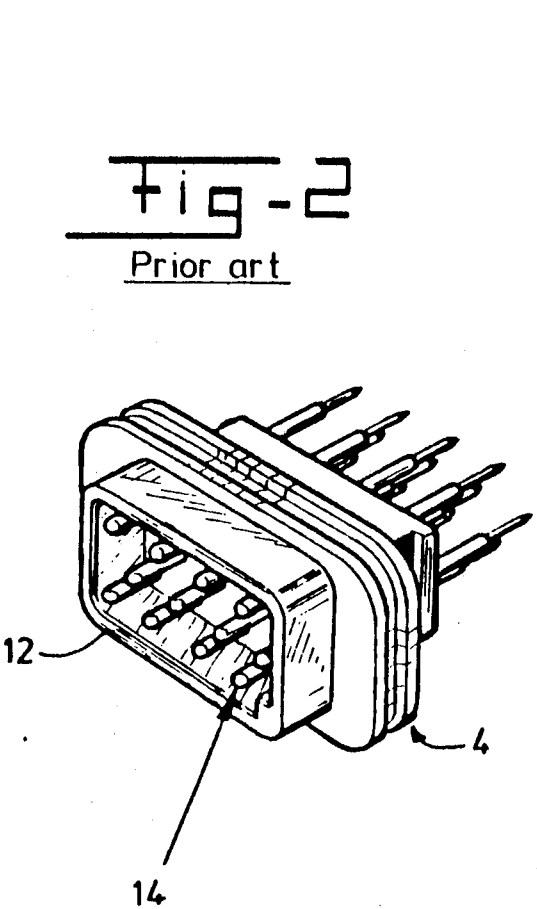
Fig-2 Prior art
FIG. 2 shows a conventional receptacle connector for mounting to electrical equipment.

As described earlier, FIG. 1 shows a receptacle connector 4 for mounting to electronic equipment which is provided with upright wall parts 7 and 8 containing recesses 10 and 11. The bosses 9 of the latching members 3, which are disposed on the housing 2 of the cable connector 1, mate with these recesses.

Figure 1:
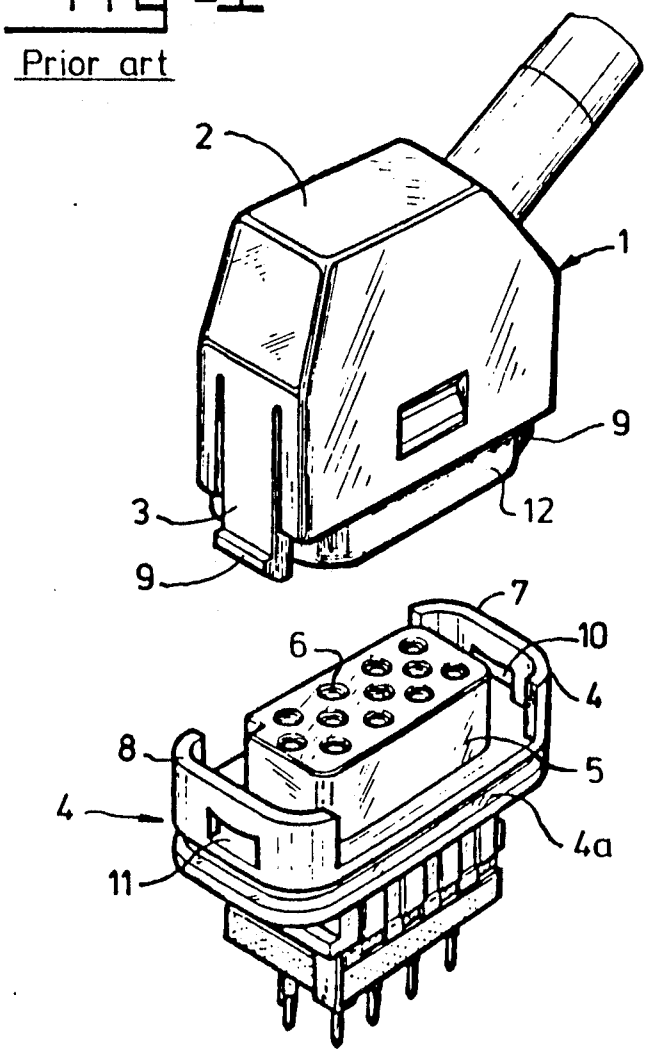
Fig-1 Prior art
FIG. 1 shows the means described in the background of the invention for locking a cable connector and a built-in receptacle connector together.

In a built-in receptacle connector of the type shown in FIG. 2, the collar 12 must be inserted through a suitable aperture in the wall of electronic equipment in order to mount and fasten the receptacle connector 4 to the wall. Upright wall parts 7 and 8 such as are shown in FIG. 1 are not, however, possible, so that the cable connector 1 cannot be locked with the latching members 3.

Figure 4:
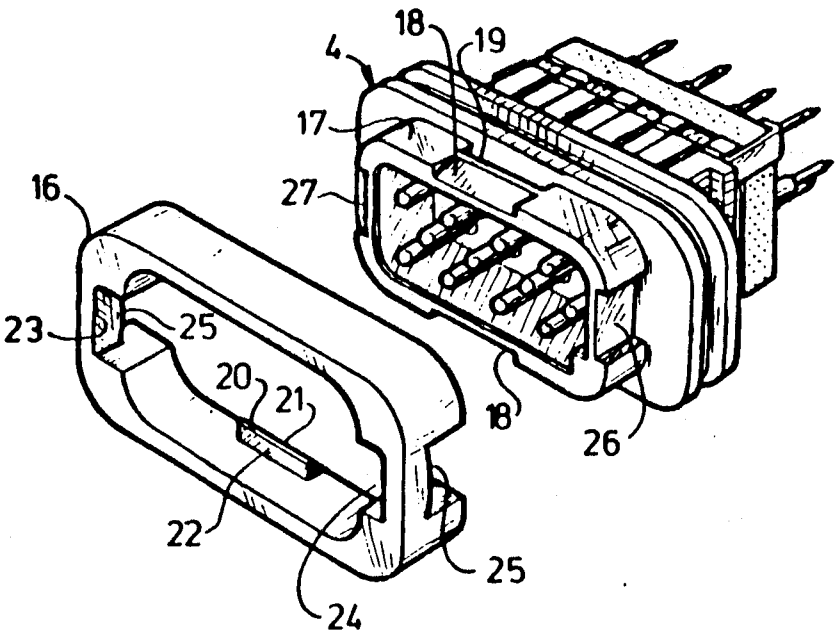
FIG. 4 shows separately the built-in receptacle connector and frame of FIG. 3.
Figure 3:
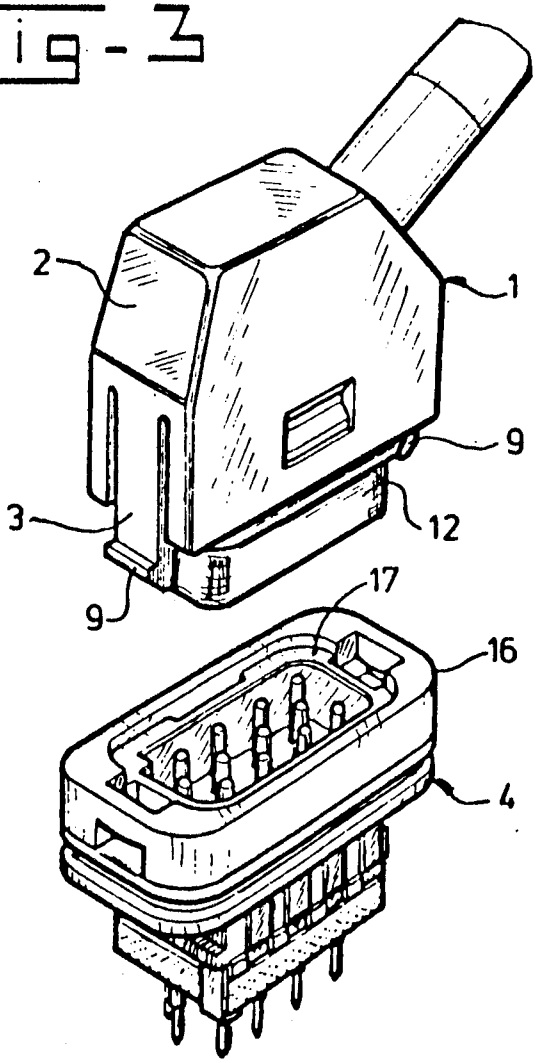
FIG. 3 shows a cable connector and a built-in receptacle connector, the built-in connector being provided with a locking frame according to the invention.

This problem can be eliminated according to the present invention through use of locking frame 16 shown in FIGS. 3 and 4. This frame 16 can be locked on the outside peripheral wall of the collar 17 of the built-in receptacle connector 4 which is also shown in FIGS. 3 and 4 (see particularly FIG. 4).

The locking frame 16 for the cable connector 1 must, of course, also be locked on the built-in connector 4. This is accomplished by locking means disposed, on the one hand, on the collar 17 and, on the other, on the inside wall of the locking frame 16. The collar 17 is fitted with boss guide faces 18 which extend outwards at an angle from the free front end of the collar 17 into the plane of the outside peripheral wall of the collar. The boss guide faces merge into recessed locking faces 19 lying at right angles to the outside peripheral wall of the collar 17. The boss guide and locking faces are provided on opposite sides of the outside peripheral wall of the collar.

The locking frame 16 is provided with bosses 20 with an upwardly slanting side 21 and a transverse face 22. The bosses 20 are fitted in the locking frame 16 in the same way as the faces 18 and 19 on opposite walls of the collar 17 as shown in FIG. 4. When this locking frame 16 is pushed over the collar 17, the bosses 20 are first pressed outwards bating walls 18, and after passing the edge of the face 19 they then spring back. The locking frame 16 is then locked onto the built-in connector 4.

To ensure that the cable connector 1 with conventional latching members 3 and bosses 9 mate and latch with a receptacle connector having the locking frame, the locking frame 16 is provided with recessed guide faces 23 and 24 which do not run downwards as far the edge of the locking frame 16, but end at locking faces 25 at right angles to the plane of the locking frame 16. The collar 17 can be provided with recessed parts 26, 27 in order to provide additional space for the bosses 9.

When the cable connector 1 is now inserted into the built-in receptacle connector 4, the bosses 9 of the latching members 3 will be pressed inwards by the guide faces 23 and 24, until on further displacement 8 the cable connector 1, these bosses 9 through the spring force of the latching members 3 snap behind the locking faces 25 of the locking frame. The cable connector 1 is herewith now also locked on the built-in connector 4.

The present invention is not limited to the embodiment shown in FIGS. 3 and 4, and modifications and additions are possible without going beyond the scope of the invention. For example, the faces 18 and 19 or recesses 26 and 27 can, of course, also be used in the central part 5 of FIG. 1 containing plug sockets 6. The equipment or built-in connector can be either the type with plug pins or one with plug sockets, which also applies to the cable connector mating therewith.

I claim:

1. A mountable electronic connector for mating in a mating direction with an electronic cable connector, the cable connector being provided with a housing having resilient cantilevered latching members for locking the cable connector to the mountable connector, said mountable connector comprising a housing which is provided at a mating end with a collar having an outer peripheral wall which extends in the mating direction of the cable connector, a plurality of electronic terminal pins disposed within said outer peripheral wall of said collar, a separate locking frame adapted to mount around and lock to the peripheral wall, said locking frame being provided with receiving and locking means for said latching members so as to maintain said connectors latched together.

2. The mountable connector according to claim 1 wherein said peripheral wall is provided with boss guide means and locking means, and the locking frame is provided with recessed bosses mating with said boss guide and locking means.

3. A mountable connector according to claim 2 wherein the boss guide means on the peripheral wall are tapered, slanted boss guide faces formed in said wall and extending tapering outwards in the mating direction from a front side of said peripheral wall, the boss guide faces merging into recessed locking faces lying at right angles to the peripheral wall, said locking frame is provided with recessed bosses for mating with said boss guide faces and said locking faces.

4. A mountable connector according to claim 3 wherein the boss guide and locking faces are disposed on opposite sides of the peripheral wall.

5. A mountable connector according to claim 2 in which the resilient cantilevered latching members of the housing of the cable connector are provided with outward-projecting locking bosses and the inside wall of the locking frame is provided with guide and locking faces for the outward-projecting bosses on the latching members.

6. A mountable connector according to claim 5 wherein the guide and locking faces for the latching members are disposed on opposite sides of the inside wall of the locking frame.

* * * * *